United States Patent [19]

Neitz

[11] 4,353,334

[45] Oct. 12, 1982

[54] METHOD OF AND APPARATUS FOR STARTING AN AIR-COMPRESSING FOUR-STROKE CYCLE INTERNAL COMBUSTION ENGINE

[75] Inventor: Alfred Neitz, Röthenbach, Fed. Rep. of Germany

[73] Assignee: Maschinenfabrik Augsburg-Nürnberg Aktiengesellschaft, Nuremberg, Fed. Rep. of Germany

[21] Appl. No.: 184,791

[22] Filed: Sep. 8, 1980

Related U.S. Application Data

[63] Continuation of Ser. No. 943,530, Aug. 17, 1978, abandoned.

[30] Foreign Application Priority Data

Aug. 20, 1977 [DE] Fed. Rep. of Germany ..... 2737601

[51] Int. Cl.[3] ..... F02N 17/00

[52] U.S. Cl. ..... 123/179 H; 123/21; 123/90.16

[58] Field of Search ..... 123/DIG. 7, 179 H, 179 A, 123/21, 556, 90.16, 90.17, 90.18, 2, 185 CA

[56] References Cited

U.S. PATENT DOCUMENTS

| | | | |
|---|---|---|---|
| 1,792,028 | 2/1931 | Peterson | 123/21 |
| 1,814,676 | 7/1931 | Estep | 123/21 |
| 2,178,152 | 10/1939 | Walker | 123/21 |
| 2,297,376 | 9/1942 | Walker | 123/21 |
| 2,823,655 | 2/1958 | Repko | 123/90.16 |
| 3,367,312 | 2/1968 | Jonsson | 123/90.16 |
| 3,884,198 | 5/1975 | Ito | 123/90.18 |

FOREIGN PATENT DOCUMENTS

| | | | |
|---|---|---|---|
| 26268 | 7/1906 | Austria | 123/21 |

*Primary Examiner*—P. S. Lall

*Attorney, Agent, or Firm*—Becker & Becker, Inc.

[57] ABSTRACT

A method of and apparatus for starting an air-compressing four-stroke cycle internal combustion engine, in which the air for the combustion process is preheated in the intake system or in chambers communicating with the intake system. The air conveying engine parts are, prior to the self-sustaining operation of the engine, heated by means of the preheated intake air, while the engine during the preheating operation is driven by means of separate power and the inlet and outlet valves are controlled in conformity with the two-stroke cycle so that each upward stroke of a piston provides an exhaust stroke and every downward stroke of a piston provides an intake stroke. The shift-over of the operation of the inlet and outlet valves from two-stroke cycle operation to four-stroke cycle operation and the admission of fuel into the cylinders are effected only when the air conveying engine parts and the air charge have reached a temperature sufficient for the start of the engine.

4 Claims, 3 Drawing Figures

METHOD OF AND APPARATUS FOR STARTING AN AIR-COMPRESSING FOUR-STROKE CYCLE INTERNAL COMBUSTION ENGINE

This is a continuation application of Ser. No. 943,530, filed Aug. 17, 1978, now abandoned, being based on German Patent Application Ser. No. P 2737601.8 filed Aug. 20, 1977 as claimed for priority under 35 USC 119.

This invention relates to a method of and apparatus for starting an air-compressing four-stroke internal combustion engine in which preheating of the air for combustion is effected in the induction system or in chambers communicating therewith.

In this type of internal combustion engine it is generally known to provide heat sources in the form of glow elements or burners in the induction system or in chambers closely associated with it whereby the air drawn in for combustion is preheated in order to facilitate the starting process, in particular when starting from cold.

However, with these devices, a relatively long time elapses from the start of the cranking of the engine until the engine runs by itself when the necessary minimum temperature of the cylinder charge is attained and the engine, in view of the fuel injection into the cylinder commencing from the start of the cranking, will eventually fire. This is due to the fact that a substantial amount of hot air or combustion gases has to be delivered through the pipes to compensate for the heat transferred to the walls of the induction system and the cylinders. Where the heat is produced by combustion in the induction system, the rate of heat that can be added per unit time is additionally limited by the fact that only a proportion of the air drawn in can be used for combustion in the induction system because it is necessary for a sufficiently high oxygen concentration to exist for the ignition and combustion of the fuel injection into the cylinder. It is also disadvantageous in the conventional starting process that the amount of fuel injected into the cylinders prior to firing of the engine is discharged as a cloud of unburned hydrocarbon through the exhaust pipe into the atmosphere.

Air delivery is effected by the engine under power from the starter motor. The method involves a high combustion of electrical power so that the starter and, primarily, the battery have to be of a very large size because the substantial friction resistance of the cold engine in being cranked through the compression cycles has to be overcome.

This is the starting point of the invention which has for its object to provide a method of and apparatus for implementing the method for an internal combustion engine of the type initially described whereby positive starting is effected quickly, satisfactorily and with the least amount of power expenditure.

According to the present invention, this object is achieved processwise in that heating of the air-conveying engine components is effected by means of the hot induction air before starting of the internal combustion engine for self-sustaining running and in that the internal combustion engine during the preheating cycle is driven by extraneous power, and in that the intake valve and the exhaust valves are controlled in such a manner that every upstroke of a piston produces an exhaust stroke and every downstroke of the piston an induction stroke, and in that change-over of the intake valve and the exhaust valves for four-stroke operation and supply of fuel to the cylinders are effected only when the components and the air charge have reached an adequate temperature for starting.

In this way, the internal combustion engine, during preheating without fuel injection into the cylinders, operates practically as an air pump in a two-stroke cycle and, consequently, delivers double the amount of preheated air through the cylinders in comparison to the four-stroke cycle. Where heat generation is effected by combustion in the induction system, the whole air volume drawn in can preferably be used for this combustion and, consequently, the heat supply per unit time can be further increased. As a result thereof, the components to be heated are heated up at a faster rate and the temperature level required for starting is reached earlier, which amounts to a considerable saving of driving power. A further power saving is obtained as a result of the bearing and piston friction during preheating being decisively reduced because the compression expansion phases of the four-stroke cycle and the associated high bearing forces are eliminated. In effect, these advantages permit a reduction of battery capacity and the size of the starter.

On reaching the component and charge temperature required for starting, preferably initiated by a temperature sensor in the induction system, in the combustion chamber wall or in the exhaust system, the change-over of the valve operation for the four-stroke cycle is effected automatically, and fuel injection is released. The engine will start readily. The "starting cloud" as a result of unburned hydrocarbons will be minimized.

According to a further feature of the invention, when a burner is used in the induction system, it is proposed that the engine is allowed to continue a few revolutions in the two-stroke cycle after the burner has been shut down before the change-over to the four-stroke cycle is effected, and fuel supply is released whereby the cylinders will be adequately filled with fresh air during starting.

Finally, starting of the engine can be further improved by utilizing the power saving in the two-stroke-cycle operation to obtain a corresponding increase in cranking speed. Using the kinetic energy stored in the driving system, the initial fuel injections, after changing over to the four-stroke cycle, will be at a higher speed. As a result, there will be improved ignition conditions compared to the conventional starting procedure.

For the sake of completeness, it should be mentioned that the preheating process is also applicable without interfering in the valve control, i.e. in conventional four-stroke operation, although to a lesser advantage.

Referring to the apparatus for implementing the method according to the invention, it is proposed that the inlet and outlet valves may have associated therewith additionally activatable control means for the intake valves and the exhaust valves whereby another lifting stroke is imparted upon the intake valves and the exhaust valves between the two valve lifts in each case.

Depending on the layout of the valve actuating mechanism, this may be effected in different ways. If, for instance, the intake valves and the exhaust valves in an internal combustion engine are actuated by rocker arms operated by cams, an if the camshaft during one rotation of the crankshaft performs only half a rotation, it is proposed according to the invention to allocate to each rocker arm two cams offset by about 180°, and to arrange the rocker arms displaceable in such a manner that they can be operated selectively by one or both cams. The two cams may have different control characteristics to match the specific requirements; but all cams would preferably be fitted on a common camshaft.

As a further development of the apparatus described, it is proposed that each rocker arm is maintained by the force of a spring acting upon it in a position in which it will cooperate with both cams associated therewith, whereas it is displaceable by hydraulic, pneumatic or electrical actuating means against the force of the spring into a position where it will cooperate only with one cam controlling the four-stroke operating mode. This results in the advantage that the valve actuating mechanism will change over automatically for preheating or "pumping" when the engine is shut down and at the same time the holding force decreases, which will immediately restore low-friction running of the drive system when starting is repeated. Another advantage resides in the fact that, when the engine is shut down, it will freely slow down to a standstill without any reaction torques resulting from compression and expansion. Particularly in the case of few cylinders and a soft engine mounting system such as would be provided, for instance, in a four-cylinder car engine, this will eliminate the unpleasant shaking of the engine during the last few rotations before standstill.

It is, of course, also within the scope of the present invention, instead of shifting the rocker arm, to movably arranged one of the two cams in such a manner that the rocker arm can be actuated selectively by one or both cams. Furthermore, it is within the scope of the present invention to provide each intake valve and each exhaust valve with two rocker arms offset from each other by 180° and operable by one cam and to arrange one of the two rocker arms so as to be movable into an inoperative position.

Basically, similar designs are possible in the case of valve actuating mechanisms using tappets instead of rocker arms to transmit the actuating motion from the cam to the valve.

Details of the present invention will appear more clearly from the following description and two typical embodiments of the invention illustrated in the drawings, in which.

Figure 1:
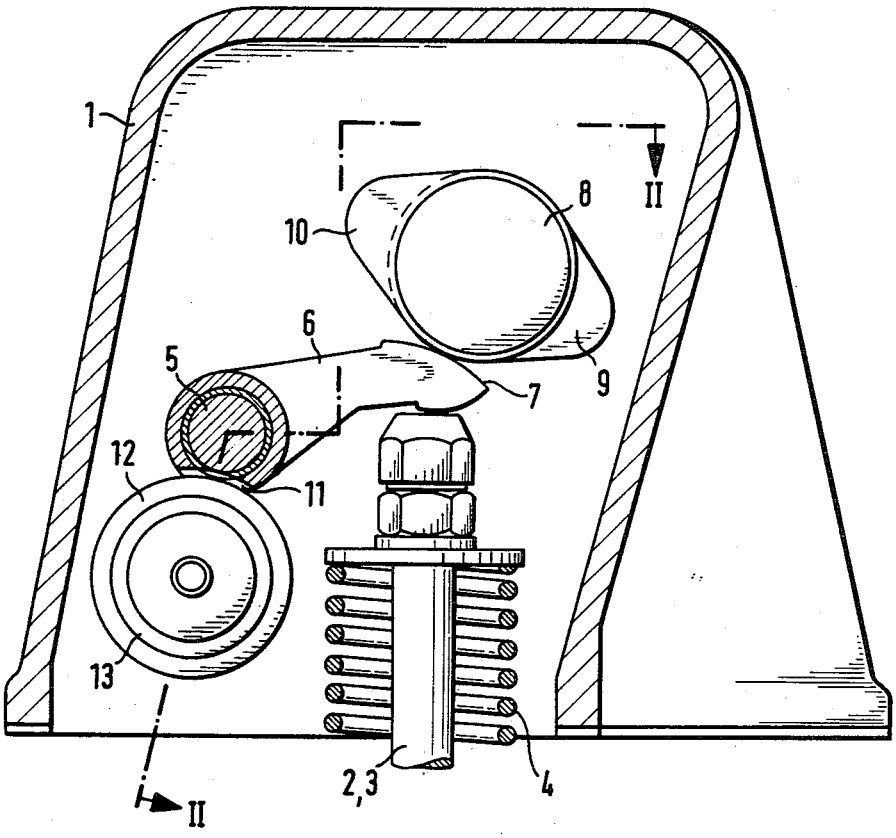
FIG. 1 is a side view of the valve actuating mechanism according to the invention.

Referring now to the drawings in detail, the drawings merely show those parts which are absolutely necessary to explain the invention. Referring to FIG. 1, there is shown a valve hood 1 in which can be seen the upper part of an intake valve 2 or exhaust valve 3 which by a spring 4 is continuously urged into its closed position. Pivotally and axially displaceably mounted on a shaft 5 is a rocker arm 6 which on the one hand rests upon the intake valve 2 or the exhaust valve 3 or the adjusting nut thereof and, on the other hand, by means of its curve-shaped track 7, contacts one or two cams 9, 10 connected to a camshaft 8, said cams being offset from each other by about 180°. The hub of the rocker arm 6 is provided with a recess 11 which is engaged by a collar 12 of an axially slidable bushing 13.

Figure 2:
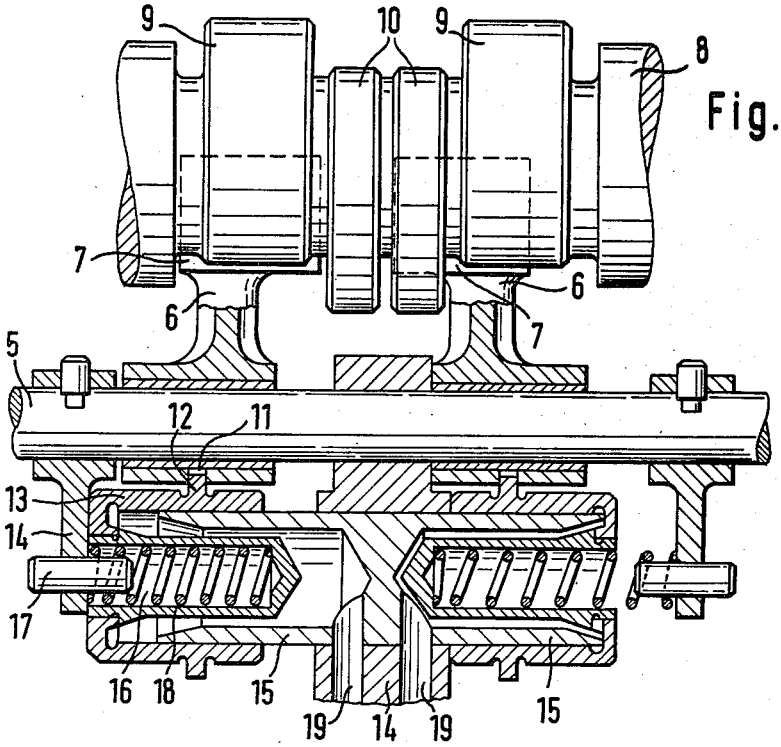
FIG. 2 is a section II—II through FIG. 1 in which two rocker arms are shown in different positions.

The bushing 13 is shown in section in FIG. 2. It surrounds a cylinder 15 which serves as guiding means and is fixedly arranged in a cylinder head wall 14. Extending from the end face of bushing 13 is a blind hole 16 housing a compression spring 18 guided by a pin 17 the free end of said spring bearing against the cylinder head wall 14. The cylinder 15 is also provided with inlet and outlet ports 19 for a hydraulic medium under pressure, preferably engine oil.

The parts described are shown duplicated in FIG. 2. Towards the left-hand section, the cylinder 15 is pressurized by a pressure medium which forces the bushing 13 against the thrust of the spring 18 against the cylinder head wall 14. By means of the collar 12, the bushing 13 displaces the rocker arm 6 in such a manner that its contact edge 7 only cooperates with the cam 9 by means of which the intake valve 2 or exhaust valve 3 is controlled in the four-stroke cycle.

The right-hand section of FIG. 2 shows the bushing 13 in its position of rest in which it is maintained by the spring 18 as soon as the pressure medium fails. In this position, the track 7 of the rocker arm 6 engages the two cams 9 and 10 associated therewith, and the intake valve 2 or the exhaust valve 3 are actuated for "pumping", i.e. the engine will operate as an air pump and deliver in the two-stroke cycle, i.e. only suction and exhaust, to expel the air from the induction system into the exhaust system.

Figure 3:
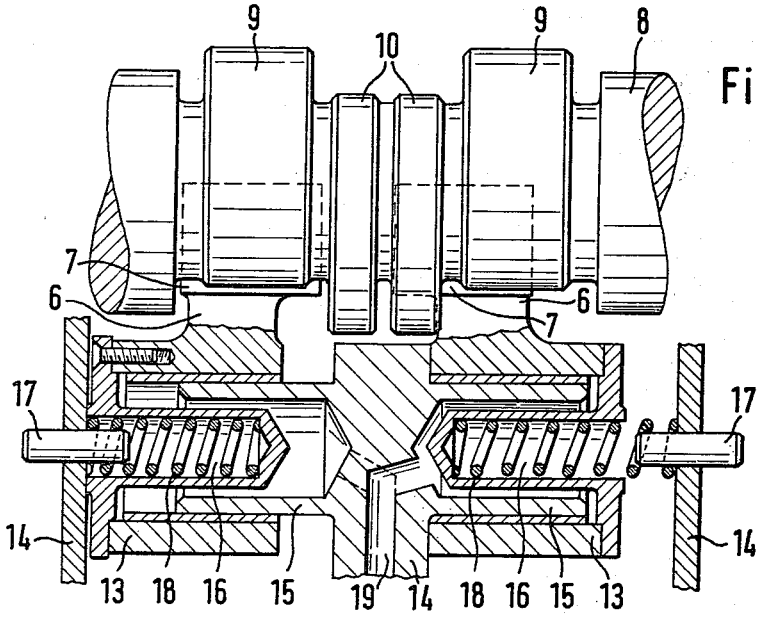
FIG. 3 is a modification of the apparatus according to FIG. 2.

FIG. 3 shows a simplified form of the valve actuating mechanism according to FIG. 2 which also shows both possible positions of the rocker arm 6. The simplification exists in the fact that the rocker arm 6 is not mounted on a separate shaft but is mounted directly on the cylinder 15, and that the hub of the rocker arm 6 simultaneously forms the bushing 13. The functions of the control system and the items correspond to those described in FIG. 2.

It is, of course, to be understood that the present invention is by no means limited to the specific showing in the drawings, but also encompasses any modifications within the scope of the appended claims.

What I claim is:

1. In an internal combustion engine having a crank shaft and an axially stationary cam shaft having cams thereon, the cam shaft being rotated by the crank shaft at one-half the speed of the crank shaft, and the engine further having spring-biased, normal-closed intake and exhaust valves opened periodically by rocker arms displaced periodically by the cams on the cam shaft, the improvement characterized by:

the cams being grouped in pairs on the cam shaft with the cams in each pair being axially juxtaposed with respect to one another and having single lobes which are circumferentially displaced from one another;

a single rocker arm positioned between each pair of cams and each of the valves, the single rocker arm having a cam follower surface of a sufficient width to engage simultaneously both cams in the pair;

means for rotatably mounting the rocker arm, wherein the rocker arm pivots to open the valve against the bias of the valve spring as the lobes engage the cam follower, said mounting means further including means allowing the rocker arm to slide in an axial direction with respect to the cam shaft;

means for limiting sliding motion of the rocker arm between a first position in which the cam follower abuts both cams of the pair and a second position in which the cam follower abuts only one of the cams;

means for biasing the rocker arm to the first position wherein the cam follower engages both cams and the engine functions initially as an air pump during starting of the engine, and means for overcoming the biasing means to urge the rocker arm to the second position in which the cam follower engages only one cam wherein the engine runs as a four-cycle engine, said means for overcoming the biasing means operating automatically upon self-sustaining operation of the engine.

2. The improvement of claim 1 wherein the means for biasing the follower to the second position is a spring.

3. The improvement of claim 2 wherein the means for overcoming the biasing means is a fluid which becomes pressurized upon self-sustaining operation of the engine.

4. The improvement of claim 1 wherein the biasing means for the rocker arm is a compression spring retained within a cap connected to the rocker arm, the compression spring having one end abutting the cap and having the other end abutting part of the engine and wherein the means for overcoming the biasing means includes a chamber around the cap which is telescoped within a portion of the rocker arm which chamber is connected to a source of fluid which fluid is pressurized upon self-sustaining running of the engine to automatically move the rocker arm to the second position.

* * * * *